US007870829B1

(12) United States Patent
Perry et al.

(10) Patent No.: US 7,870,829 B1
(45) Date of Patent: Jan. 18, 2011

(54) BOAT ANCHOR SYSTEM

(76) Inventors: Heath A. Perry, 321 Shore Dr. East, Oldsmar, FL (US) 34677; Kathryn E. Perry, 321 Shore Dr. East, Oldsmar, FL (US) 34677

( * ) Notice: Subject to any disclaimer, the term of this patent is extended or adjusted under 35 U.S.C. 154(b) by 542 days.

(21) Appl. No.: 12/011,179

(22) Filed: Jan. 24, 2008

(51) Int. Cl.
*B63B 21/00* (2006.01)
*B63B 21/24* (2006.01)
*B63B 21/26* (2006.01)

(52) U.S. Cl. ..... 114/230.1; 114/230.13; 114/230.15; 114/294; 114/343

(58) Field of Classification Search ..... 114/221 R, 114/230.1, 230.13–230.19, 230.27–230.3, 114/293–295, 343, 364; 440/36; 52/155, 52/156

See application file for complete search history.

(56) References Cited

U.S. PATENT DOCUMENTS 2,912,953 A * 11/1959 Olsen ..... 114/230.18
2,979,014 A * 4/1961 Yordi ..... 114/230.16
6,041,730 A 3/2000 Oliverio
6,065,420 A * 5/2000 Smith ..... 114/343
6,220,197 B1 * 4/2001 Pohlman ..... 114/294
6,422,169 B1 7/2002 Schwantes

* cited by examiner

*Primary Examiner*—Ajay Vasudeva

(57) ABSTRACT

A securement assembly is provided. A support has a lower end and an upper end. The lower end is coupled to the securement assembly. A spear has a leading end and trailing end with a central extent between the leading and trailing ends. A cylindrical member has a passageway slidably receiving the spear between the leading and trailing ends. Adjustment components couple the cylindrical member to the upper end of the support. The adjustment components are adapted to move the cylindrical member and spear between any of a plurality of orientations. The plurality of orientations include a generally horizontal orientation for storing and transportation and a generally vertical orientation for deploying and use.

8 Claims, 4 Drawing Sheets

BOAT ANCHOR SYSTEM

BACKGROUND OF THE INVENTION

1. Field of the Invention

The present invention relates to a boat anchor system and more particularly pertains to storing and re-orienting and deploying a boat anchor in a safe, convenient and economical manner.

2. Description of the Prior Art

The use of anchor systems of known designs and configurations is known in the prior art. More specifically, anchor systems of known designs and configurations previously devised and utilized for the purpose of securing a boat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,041,730 issued Mar. 28, 2000 to Oliverio relates to a Shallow Water Anchor and U.S. Pat. No. 6,422,169 issued Jul. 23, 2002 to Schwantes relates to a Boat Mooring Device.

While these devices fulfill their respective, particular objectives and requirements, the aforementioned patents do not describe a boat anchor system that allows for storing and re-orienting and deploying a boat anchor in a safe, convenient and economical manner.

In this respect, the boat anchor system according to the present invention substantially departs from the conventional concepts and designs of the prior art, and in doing so provides an apparatus primarily developed for the purpose of storing and re-orienting and deploying a boat anchor in a safe, convenient and economical manner.

Therefore, it can be appreciated that there exists a continuing need for a new and improved boat anchor system which can be used for storing and re-orienting and deploying a boat anchor in a safe, convenient and economical manner. In this regard, the present invention substantially fulfills this need.

SUMMARY OF THE INVENTION

In view of the foregoing disadvantages inherent in the known types of anchor systems of known designs and configurations now present in the prior art, the present invention provides an improved boat anchor system. As such, the general purpose of the present invention, which will be described subsequently in greater detail, is to provide a new and improved boat anchor system and method which has all the advantages of the prior art and none of the disadvantages.

To attain this, the present invention essentially comprises a boat anchor system. First provided is a securement assembly. The securement assembly has an upper plate. The upper plate is in a rectangular configuration. The upper plate has four corner holes. The securement assembly has a lower plate. The lower plate is in a rectangular configuration. The lower plate has four corner holes. The four corner holes of the lower plate are aligned with the holes of the upper plate. The securement assembly has threaded fasteners. The securement assembly also has nuts. A rear portion of a boat is provided. The threaded fasteners and nuts coupling the plates to the rear portion of a boat. The upper plate has an upper surface. The upper surface of the upper plate has an upwardly extending short cylindrical tube.

A tubular support is provided. The tubular support has a lower end. The lower end of the tubular support is rotatably received in the short cylindrical tube. The tubular support has an upper end. The upper end of the tubular support has a vertically disposed cylindrical sleeve. A bend of about 60 degrees is provided between the upper and lower ends. The short cylindrical tube has a threaded aperture and a bolt. The threaded aperture and bolt are adapted to fix the orientation of the tubular support when tightened. The threaded aperture and bolt are further adapted to allow reorienting the tubular support when loosened.

Provided next is a spear. The spear is fabricated of fiberglass. The spear has a leading end. The leading end of the spear has a point. The spear has a trailing end. The spear has an upper collar. The upper collar is positioned in proximity to the upper end of the spear. The spear has a lower collar. The lower collar is positioned in proximity to the lower end of the spear. Each collar has an aperture. The aperture of each collar is aligned with an associated aperture in the spear. A locking cam is provided. The locking cam extends through the aperture of each collar for releasable securement with respect to the spear.

Further provided is a cylindrical member. The cylindrical member has a passageway. The passageway slidably receives the spear between the upper and lower collars. The passageway has a diameter less than the diameter of the collars. In this manner the extent of axial movement of the spear within the cylindrical member is limited by the position of the collars on the spear.

Provided last are adjustment components. The adjustment components couple the cylindrical member to the cylindrical sleeve at the upper end of the tubular support. The adjustment components include a primary T-shaped member. The primary T-shaped member has a tubular base piece. The tubular base piece extends vertically into the vertically disposed cylindrical sleeve. The primary T-shaped member has a tubular cross piece. The tubular cross piece extends horizontally. The vertically disposed cylindrical sleeve has a threaded aperture and a bolt. The threaded aperture and bolt are adapted to fix the orientation of the primary T-shaped member about a vertical axis when tightened. The threaded aperture and bolt are further adapted to allow reorienting the primary T-shaped member when loosened.

The adjustment components also include a secondary T-shaped member. The secondary T-shaped member has a tubular base piece. The tubular base piece extends horizontally into the horizontally disposed tubular cross piece of the primary T-shaped member. The secondary T-shaped member has a tubular cross piece. The tubular cross piece constitutes the cylindrical member. The horizontally disposed cross piece of the primary T-shaped member has a threaded aperture and a bolt. The threaded aperture and bolt are adapted to fix the orientation of the secondary T-shaped member about a horizontal axis when tightened. The threaded aperture and bolt are further adapted to allow reorienting the secondary T-shaped member when loosened. The base pieces of each T-shaped member has a diametric aperture. The diametric aperture is provided adjacent to its end opposite from its cross piece. An associated locking pin is provided. The locking pin precludes inadvertent removal from the cylindrical sleeve and cross piece of the primary T-shaped member. The adjustment components are adapted to move the cylindrical member and spear between any of a plurality of orientations. The plurality of orientations includes a horizontal orientation for storing and transportation. The plurality of orientations also includes a vertical orientation for deploying and use.

As used herein, the term boat is intended to mean any type of boat including, but not limited to, bay boats, john boats, flats boats, canoes, kayaks, and the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat anchor system which has all of the advantages of the prior art anchor systems of known designs and configurations and none of the disadvantages.

It is another object of the present invention to provide a new and improved boat anchor system which may be easily and efficiently manufactured and marketed.

It is further object of the present invention to provide a new and improved boat anchor system which is of durable and reliable constructions.

An even further object of the present invention is to provide a new and improved boat anchor system which is susceptible of a low cost of manufacture with regard to both materials and labor, and which accordingly is then susceptible of low prices of sale to the consuming public, thereby making such boat anchor system economically available to the buying public.

Even still another object of the present invention is to provide a boat anchor system for storing and re-orienting and deploying a boat anchor in a safe, convenient and economical manner.

Lastly, it is an object of the present invention to provide a new and improved boat anchor system. A securement assembly is provided. A support has a lower end and an upper end. The lower end is coupled to the securement assembly. A spear has a leading end and trailing end with a central extent between the leading and trailing ends. A cylindrical member has a passageway slidably receiving the spear between the leading and trailing ends. Adjustment components couple the cylindrical member to the upper end of the support. The adjustment components are adapted to move the cylindrical member and spear between any of a plurality of orientations. The plurality of orientations include a generally horizontal orientation for storing and transportation and a generally vertical orientation for deploying and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
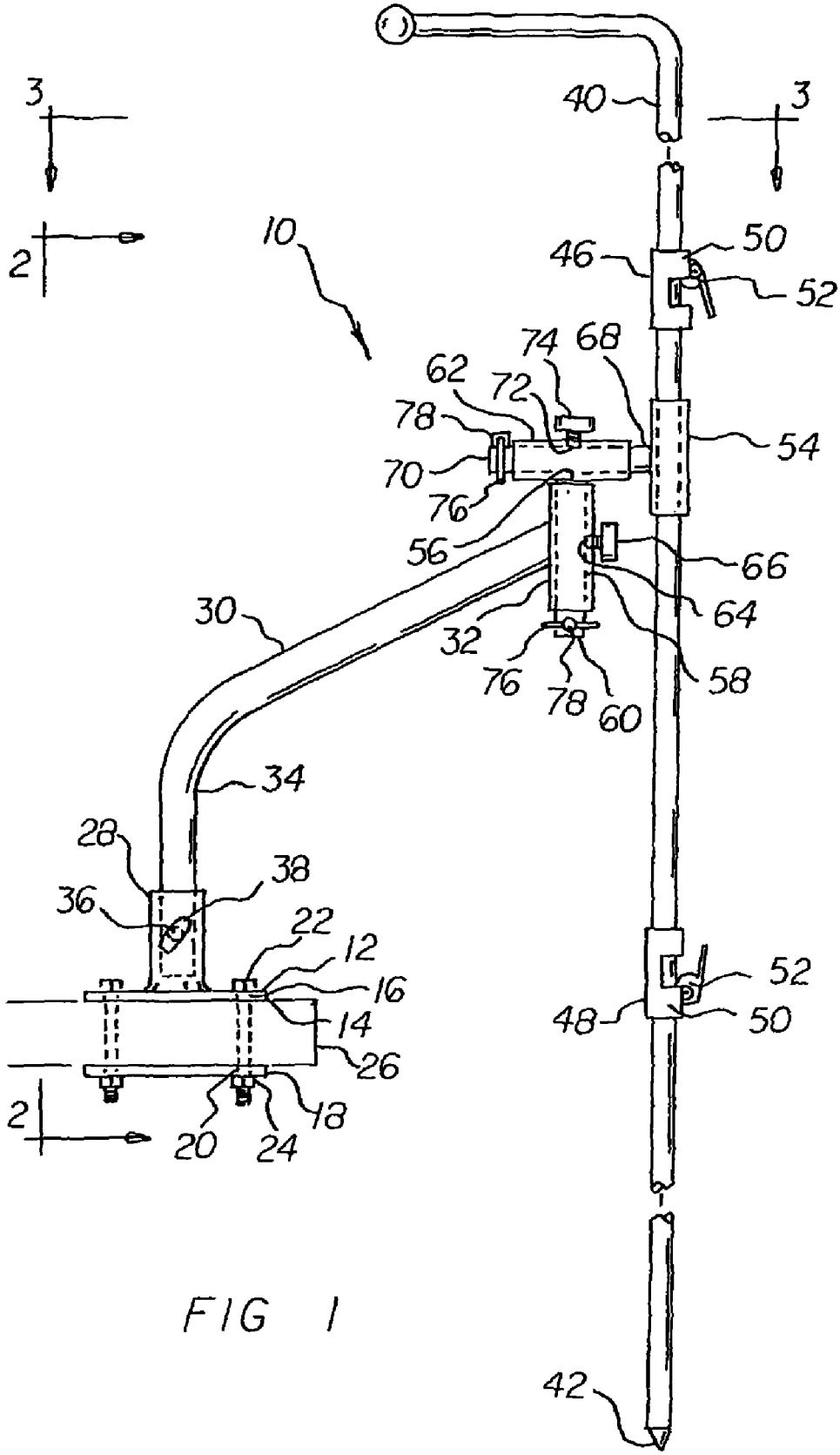
FIG. 1 is a side elevational view of a boat anchor system constructed in accordance with the principles of the present invention.
Figure 2:
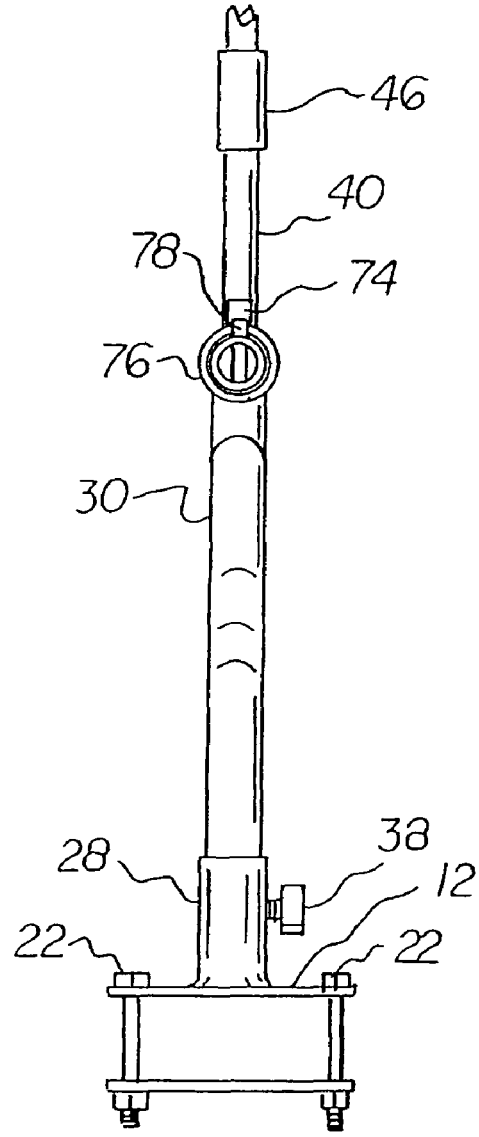
FIG. 2 is a front elevational view of the system taken along line 2-2 of FIG. 1.
Figure 3:
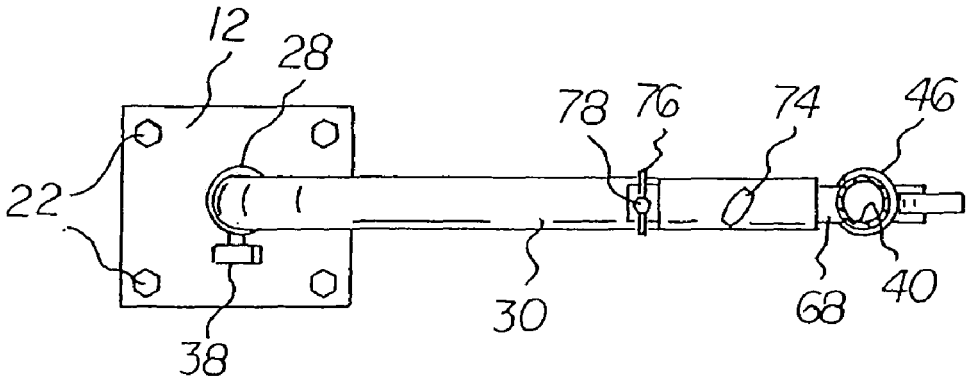
FIG. 3 is a plan view of the system taken along line 3-3 of FIG. 1.
Figure 4:
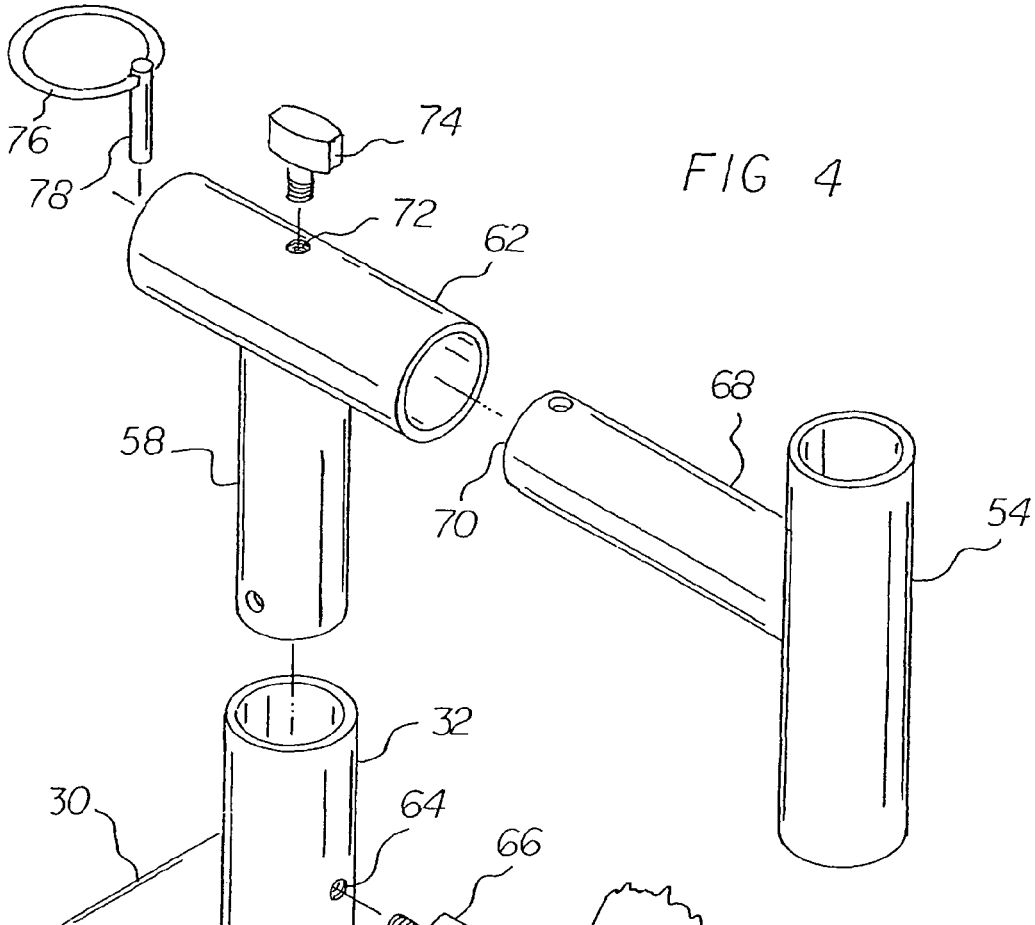
FIG. 4 is an exploded perspective illustration of the primary embodiment of the invention shown in the prior Figures.
Figure 5:
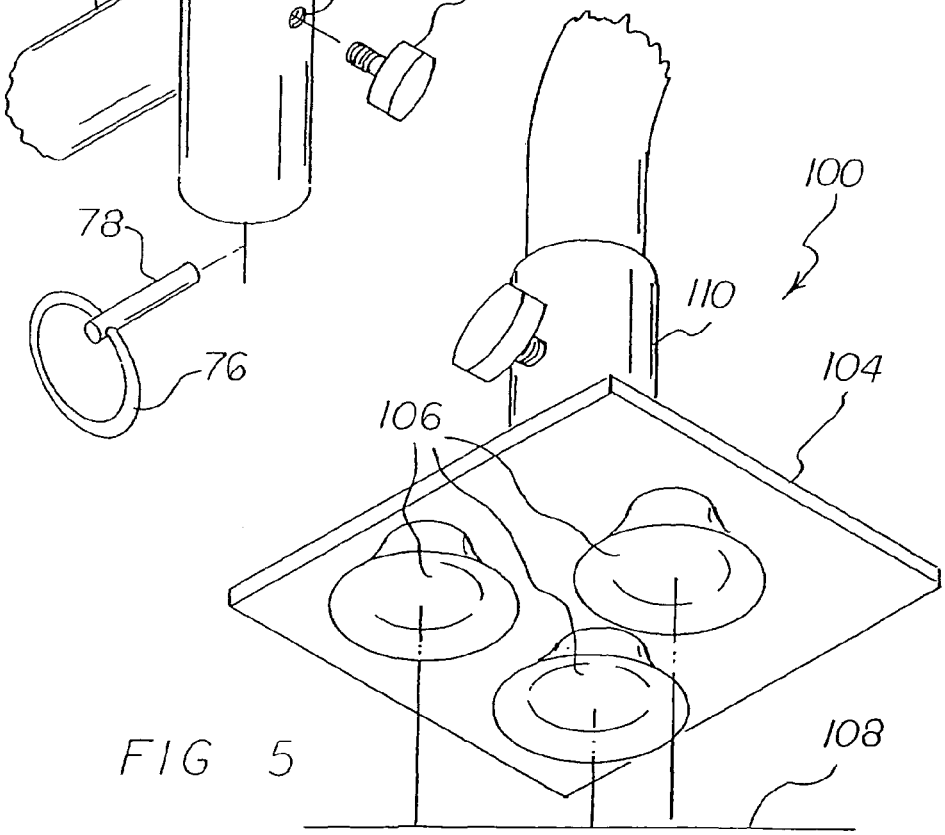
FIG. 5 is an exploded perspective illustration of an alternate embodiment of the invention.
Figure 6:
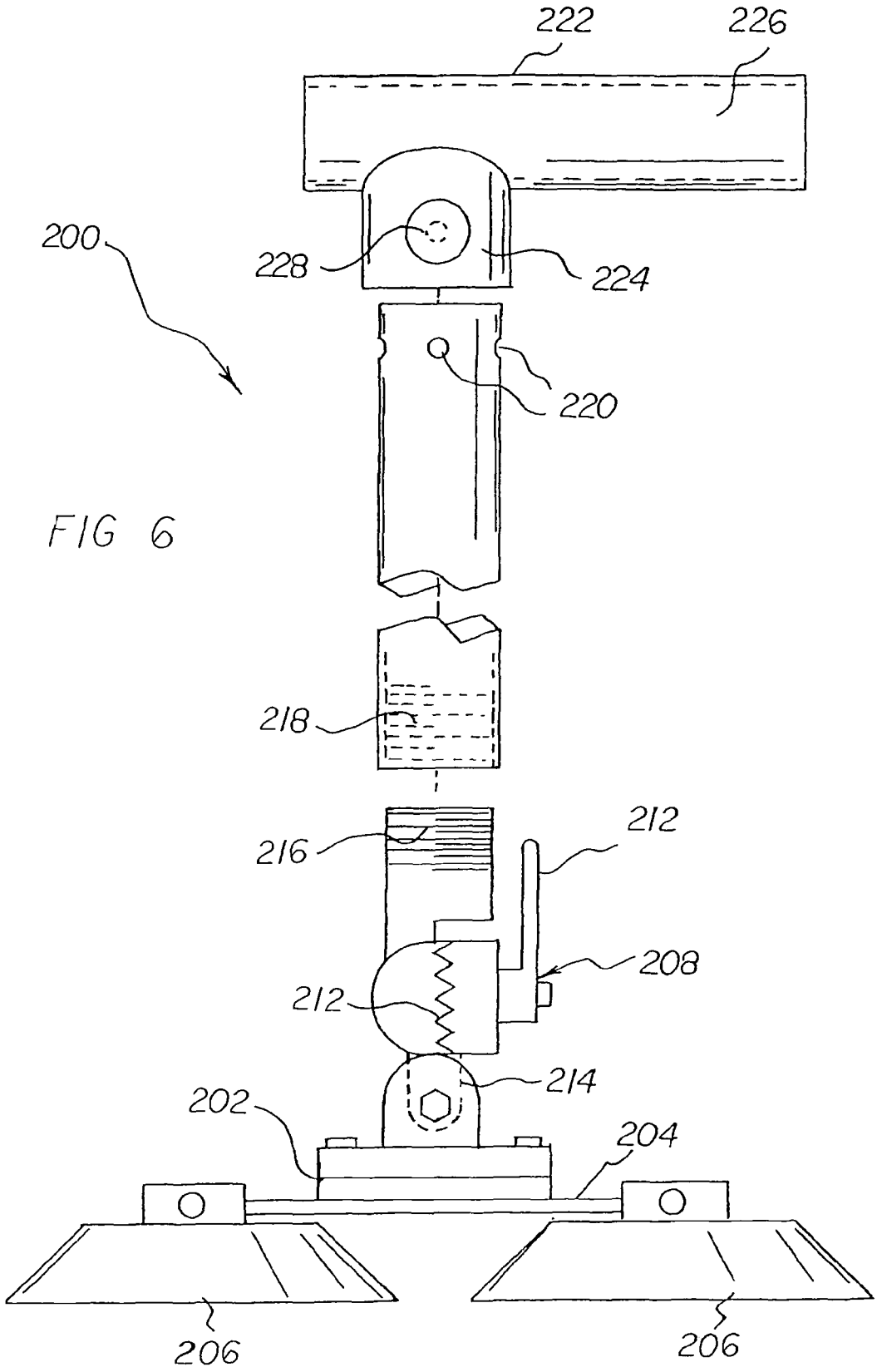
FIG. 6 is an exploded perspective illustration of another alternate embodiment of the invention.

With reference now to the drawings, and in particular to FIG. 1 thereof, the preferred embodiment of the new and improved boat anchor system embodying the principles and concepts of the present invention and generally designated by the reference numeral 10 will be described.

The present invention, the boat anchor system 10 is comprised of a plurality of components. Such components in their broadest context include a securement assembly, a support, a spear, a cylindrical member and adjustment components. Such components are individually configured and correlated with respect to each other so as to attain the desired objective.

First provided is a securement assembly 12. The securement assembly has an upper plate 14. The upper plate is in a rectangular configuration. The upper plate has four corner holes 16. The securement assembly has a lower plate 18. The lower plate is in a rectangular configuration. The lower plate has four corner holes 20. The four corner holes of the lower plate are aligned with the holes of the upper plate. The securement assembly has threaded fasteners 22. The securement assembly also has nuts 24. A rear portion of a boat 26 is provided. The threaded fasteners and nuts coupling the plates to the rear portion of a boat. The upper plate has an upper surface. The upper surface of the upper plate has an upwardly extending short cylindrical tube 28.

A tubular support 30 is provided. The tubular support has a lower end. The lower end of the tubular support is rotatably received in the short cylindrical tube. The tubular support has an upper end. The upper end of the tubular support has a vertically disposed cylindrical sleeve 32. A bend 34 of about 60 degrees is provided between the upper and lower ends. The short cylindrical tube has a threaded aperture 36 and a bolt 38. The threaded aperture and bolt are adapted to fix the orientation of the tubular support when tightened. The threaded aperture and bolt are further adapted to allow reorienting the tubular support when loosened.

Provided next is a spear 40. The spear is fabricated of fiberglass. The spear has a leading end. The leading end of the spear has a point 42. The spear has a trailing end. The spear has an upper collar 46. The upper collar is positioned in proximity to the upper end of the spear. The spear has a lower collar 48. The lower collar is positioned in proximity to the lower end of the spear. Each collar has an aperture 50. The aperture of each collar is aligned with an associated aperture in the spear. A locking cam 52 is provided. The locking cam extends through the aperture of each collar for releasable securement with respect to the spear.

Further provided is a cylindrical member 54. The cylindrical member has a passageway. The passageway slidably receives the spear between the upper and lower collars. The passageway has a diameter less than the diameter of the collars. In this manner the extent of axial movement of the spear within the cylindrical member is limited by the position of the collars on the spear.

Provided last are adjustment components 56. The adjustment components couple the cylindrical member to the cylindrical sleeve at the upper end of the tubular support. The adjustment components include a primary T-shaped member 58. The primary T-shaped member has a tubular base piece 60. The tubular base piece extends vertically into the vertically disposed cylindrical sleeve. The primary T-shaped member has a tubular cross piece 62. The tubular cross piece extends horizontally. The vertically disposed cylindrical sleeve has a threaded aperture 64 and a bolt 66. The threaded aperture and bolt are adapted to fix the orientation of the primary T-shaped member about a vertical axis when tightened. The threaded aperture and bolt are further adapted to allow reorienting the primary T-shaped member when loosened.

The adjustment components also include a secondary T-shaped member 68. The secondary T-shaped member has a tubular base piece 70. The tubular base piece extends horizontally into the horizontally disposed tubular cross piece of the primary T-shaped member. The secondary T-shaped member has a tubular cross piece 54. The tubular cross piece constitutes the cylindrical member. The horizontally disposed cross piece of the primary T-shaped member has a threaded aperture 72 and a bolt 74. The threaded aperture and bolt are adapted to fix the orientation of the secondary T-shaped member about a horizontal axis when tightened. The threaded aperture and bolt are further adapted to allow reorienting the secondary T-shaped member when loosened. The base pieces of each T-shaped member has a diametric aperture 76. The diametric aperture is provided adjacent to its end opposite from its cross piece. An associated locking pin 78 is provided. The locking pin precludes inadvertent removal from the cylindrical sleeve and cross piece of the primary T-shaped member. The adjustment components are adapted to move the cylindrical member and spear between any of a plurality of orientations. The plurality of orientations includes a horizontal orientation for storing and transportation. The plurality of orientations also includes a vertical orientation for deploying and use.

As used herein, the term boat is intended to mean any type of boat including, but not limited to, bay boats, john boats, flats boats, canoes, kayaks, and the like.

An alternate embodiment of the system 100 is provided. The securement assembly includes an upper plate 104. The securement assembly includes a plurality of suction cups 106. A rear portion of a boat 108 is provided. The suction cups couple the plate and system to a rear portion of a boat. The upper plate has an upper surface. The upper surface of the upper plate has an upwardly extending short cylindrical tube 110.

Another alternate embodiment of the system 200 is provided. The securement assembly includes an upper mounting plate 202. The securement assembly includes a lower mounting bridge plate 204. The securement assembly includes a plurality of suction cups 206. The suction cups couple the plates and system to a boat. A flat surface ratcheting mount 208 is provided. The flat surface ratcheting mount has a handle 210 and meshing teeth 212 coupled in response to the manipulation of the handle. A rotatable joint 214 is provided. The rotatable joint has a first projection. The first projection extends upwardly from the upper mounting plate. The rotatable joint has a second projection. The second projection extends downwardly from the upper ratcheting mount. A pivot pin is provided there between. A tubular component 216 is provided. The tubular component extends upwardly from the ratcheting mount.

A tubular support 218 is provided. The tubular support has a lower end. The lower end of the tubular support is coupled to the ratcheting mount. The tubular support has an upper end. Apertures are provided at 90, 180, 270 and 360 degrees. A singular T-shaped member 222 is provided. The singular T-shaped member has a base piece 224. The base piece is received in the upper end of the tubular support. The singular T-shaped member has a cross piece. The cross piece is the cylindrical member receiving the spear. The base piece includes a spring loaded locating knob/pin 228. In this member the rotational orientation of the T-shaped member and spear with respect to the apertures of the tubular support is secured.

It should be understood the rotational orientation of the various tubular components is secured by mechanisms including, but not limited to, spring loaded locating knobs/pins, ratcheting mounts, locking pins, threaded fasteners, bolts and the like. Such mechanisms are to a large extent interchangeable, selected as a function of the particular application.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat anchor system comprising:

mounted on a portion of a boat;

a tubular support having a lower end coupled to the securement assembly and an upper end;

a spear anchor having a leading end and trailing end with a central extent between the leading and trailing ends the leading end being tapered to a point and configured for embedding in ground;

a cylindrical member with a passageway slidably receiving the spear anchor between the leading and trailing ends and a locking cam for locking the spear anchor in a plurality of positions relative to the cylindrical member; and adjustment components coupling the cylindrical member to the upper end of the support, the adjustment components adapted to move the cylindrical member and the spear anchor between any of a plurality of orientations including a generally horizontal orientation for storing and transportation and a generally vertical orientation for deploying and use.

2. The system as set forth in claim 1 wherein the securement assembly includes an upper plate in a rectangular configuration with four corner holes and a lower plate in a rectangular configuration with four corner holes aligned with the holes of the upper plate and with threaded fasteners and nuts coupling the plates to a rear portion of a boat, the upper plate having an upper surface with an upwardly extending short cylindrical tube.

3. The system as set forth in claim 2 wherein the tubular support has a lower end rotatably received in the short cylindrical tube and an upper end formed with a vertically disposed cylindrical sleeve and with a bend of about 60 degrees between the upper and lower ends, the short cylindrical tube having a threaded aperture with a bolt adapted to fix the orientation of the tubular support when tightened and to allow reorienting the tubular support when loosened.

4. The system as set forth in claim 3 wherein the spear anchor is fabricated of fiberglass, the spear anchor including upper and lower collars positioned in proximity to the respective ends of the spear anchor.

5. The system as set forth in claim 4 wherein the adjustment components include a primary T-shaped member with a tubular base piece extending vertically into the vertically disposed cylindrical sleeve and a tubular cross piece extending horizontally, the vertically disposed cylindrical sleeve having a threaded aperture with a bolt adapted to fix the orientation of the primary T-shaped member about a vertical axis when tightened and to allow reorienting the primary T-shaped member when loosened, the adjustment components also including a secondary T-shaped member with a tubular base piece extending horizontally into the horizontally disposed tubular cross piece of the primary T-shaped member and a tubular cross piece constituting the cylindrical member, the horizontally disposed cross piece of the primary T-shaped member having a threaded aperture with a bolt adapted to fix the orientation of the secondary T-shaped member about a horizontal axis when tightened and to allow reorienting the secondary T-shaped member when loosened, the adjustment components adapted to move the cylindrical member and the spear anchor between any of a plurality of orientations including a horizontal orientation for storing and transportation and a vertical orientation for deploying and use.

6. The system as set forth in claim 1 wherein the securement assembly includes an upper plate and a plurality of suction cups coupling the plate and system to a rear portion of a boat, the upper plate having an upper surface with an upwardly extending short cylindrical tube.

7. The system as set forth in claim 1 wherein the securement assembly includes an upper mounting plate with a lower mounting bridge plate and a plurality of suction cups coupling the plates and system to a boat, a flat surface ratcheting mount with a handle and meshing teeth coupled in response to the manipulation of the handle, a rotatable joint formed of a first projection extending upwardly from the upper mounting plate and a second projection extending downwardly from the upper ratcheting mount with a pivot pin there between, a tubular component extending upwardly from the ratcheting mount and a tubular support having a lower end coupled to the ratcheting mount and a tubular upper end with apertures at 90, 180, 270 and 360 degrees, and a singular T-shaped member with a base piece received in the upper end of the tubular support and a cross piece being the cylindrical member receiving the spear anchor, the base piece including a spring loaded locating knob/pin for securing the rotational orientation of the T-shaped member and the spear anchor with respect to the apertures of the tubular support.

8. A boat anchor system for storing and re-orienting and deploying a boat anchor in a safe, convenient and economical manner comprising, in combination:

a securement assembly having an upper plate in a rectangular configuration with four corner holes and a lower plate in a rectangular configuration with four corner holes aligned with the holes of the upper plate and with threaded fasteners and nuts coupling the plates to a rear portion of a boat, the upper plate having an upper surface with an upwardly extending short cylindrical tube;

a tubular support having a lower end rotatably received in the short cylindrical tube and an upper end formed with a vertically disposed cylindrical sleeve and with a bend of about 60 degrees between the upper and lower ends, the short cylindrical tube having a threaded aperture with a bolt adapted to fix the orientation of the tubular support when tightened and to allow reorienting the tubular support when loosened;

a spear fabricated of fiberglass anchor and having a leading end formed with a point and trailing end, the spear anchor including an upper collar positioned in proximity to the trailing end of the spear anchor and a lower collar positioned in proximity to the leading end of the spear anchor, a locking cam extending through an aperture of each collar for releasable securement with respect to the spear anchor;

a cylindrical member with a passageway slidably receiving the spear anchor between the upper and lower collars, the passageway having a diameter less than the diameter of the collars whereby the extent of axial movement of the spear anchor within the cylindrical member is limited by the position of the collars on the spear anchor; and adjustment components coupling the cylindrical member to the cylindrical sleeve at the upper end of the tubular support, the adjustment components including a primary T-shaped member with a tubular base piece extending vertically into the vertically disposed cylindrical sleeve and a tubular cross piece extending horizontally, the vertically disposed cylindrical sleeve having a threaded aperture with a bolt adapted to fix the orientation of the primary T-shaped member about a vertical axis when tightened and to allow reorienting the primary T-shaped member when loosened, the adjustment components also including a secondary T-shaped member with a tubular base piece extending horizontally into the horizontally disposed tubular cross piece of the primary T-shaped member and a tubular cross piece constituting the cylindrical member, the horizontally disposed cross piece of the primary T-shaped member having a threaded aperture with a bolt adapted to fix the orientation of the secondary T-shaped member about a horizontal axis when tightened and to allow reorienting the secondary T-shaped member when loosened, the base pieces of each T-shaped member having a diametric aperture adjacent to its end opposite from its cross piece and with an associated locking pin to preclude inadvertent removal from the cylindrical sleeve and cross piece of the primary T-shaped member, the adjustment components adapted to move the cylindrical member and the spear anchor between any of a plurality of orientations including a horizontal orientation for storing and transportation and for a vertical orientation for deploying and use.

* * * * *